US007083441B1

(12) United States Patent
Lee

(10) Patent No.: US 7,083,441 B1
(45) Date of Patent: Aug. 1, 2006

(54) ELECTRONIC CARD CONNECTOR WITH FAKE CARD

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 11/084,088

(22) Filed: Mar. 21, 2005

(51) Int. Cl.
*H01R 13/44* (2006.01)

(52) U.S. Cl. ..... 439/148; 439/630

(58) Field of Classification Search ..... 439/148 I, 439/218, 352, 483, 630 X, 946; 361/737; 235/441, 492

See application file for complete search history.

(56) References Cited

U.S. PATENT DOCUMENTS 6,101,372 A * 8/2000 Kubo ..... 455/558
6,269,005 B1 * 7/2001 Tung et al. ..... 361/737
6,328,598 B1 * 12/2001 Harris, Jr. ..... 439/516
6,402,529 B1 * 6/2002 Saito et al. ..... 439/74
6,830,474 B1 * 12/2004 Liu et al. ..... 439/489

* cited by examiner

*Primary Examiner*—Thanh-Tam Le
(74) *Attorney, Agent, or Firm*—Rosenberg, Klein & Lee

(57) ABSTRACT

An electronic card connector with fake card, including a main body. A front end of the main body is inward recessed to form an electronic card socket in which two different types of electronic cards can be inserted to respectively correspondingly connect with terminals at a bottom end of the electronic card socket. The fake card can be inserted in the electronic card socket. The fake card and the electronic card socket define therebetween a space in which only one corresponding type of electronic card can be inserted.

7 Claims, 6 Drawing Sheets

ELECTRONIC CARD CONNECTOR WITH FAKE CARD

BACKGROUND OF THE INVENTION

1. Field of the Invention

The present invention is related to an electronic card connector with fake card. The fake card can be inserted into an electronic card socket of the connector. The fake card and the electronic card socket define therebetween a space in which only one corresponding type of electronic card can be inserted.

2. Description of the Prior Art

An electronic card connector is often installed on an electronic terminal product such as a notebook computer, office machine, card reader, display, etc. An electronic card can be inserted into the electronic card connector for storing, recording or reading electronic data or connecting with the internet. The existent express cards include two different types of electronic cards with different sizes. In order to apply both specifications of electronic cards to the same electronic terminal product, an electronic card connector has been developed. The electronic card connector has an electronic card socket in which both types of electronic cards can be inserted to connect with corresponding terminals for activating the electronic cards.

However, the electronic card socket of the conventional electronic card connector has a width larger than or equal to the width of the largest electronic card which is allowed to be inserted into the electronic card socket. Therefore, when a smaller size of electronic card is inserted into the socket, at least one side of the electronic card is not supported or guided. As a result, when inserting the smaller electronic card into the electronic card connector, the electronic card is often biased. Therefore, the electronic card can be hardly smoothly inserted into the socket and activated. This will make the card reader unable to successfully read the data of the electronic card.

SUMMARY OF THE INVENTION

It is therefore a primary object of the present invention to provide an electronic card connector with fake card. The electronic card connector includes a main body. A front end of the main body is inward recessed to form an electronic card socket in which two different types of electronic cards can be inserted to respectively correspondingly connect with terminals at a bottom end of the electronic card socket. The fake card can be inserted in the electronic card socket. The fake card and the electronic card socket define therebetween a space in which only one corresponding type of electronic card can be inserted.

According to the above arrangement, when the fake card of the present invention is inserted in the electronic card socket of the electronic card connector, the fake card and the electronic card socket define therebetween a space adapted to the smaller size of the electronic card to be inserted into the electronic card socket. Therefore, when the electronic card is inserted into the electronic card socket, the electronic card is guided by the fake card without biasing. Accordingly, the electronic card can slide into the electronic card socket in a true path to connect with the corresponding terminals of the connector. In addition, the fake card has grounding plate for contacting with the inserted electronic card to complete the grounding of the electronic card. Accordingly, the signal of the electronic card can be more stably transmitted.

The present invention can be best understood through the following description and accompanying drawings wherein:

DETAILED DESCRIPTION OF THE PREFERRED EMBODIMENTS

Please refer to FIGS. 1 to 7. The electronic card connector 10 with fake card of the present invention includes a main body 11. A front end of the main body 11 is inward recessed to form an electronic card socket 12 in which two different types of electronic cards 4*a*, 4*b* can be inserted. The inserted electronic cards 4*a*, 4*b* can be respectively correspondingly connected with the terminals 13*a*, 13*b* at the bottom end of the electronic card socket 12. The present invention is characterized in that a fake card 20 is inserted in the electronic card socket 12. The fake card 20 and the electronic card socket 12 define a space in which only one type of electronic card 4*b* can be snugly inserted. Therefore, the fake card 20 serves to guide the electronic card 4*b* when inserted into the electronic card connector 10.

The electronic card connector 10 of the present invention can be mounted on an electronic product such as a notebook computer, desktop computer mainframe, display, etc. Alternatively, the electronic card connector 10 can be an externally connectable product which is connectable to a terminal product via a transmission line. The pattern of the electronic card connector 10 of the present invention is not limited.

Figure 1:
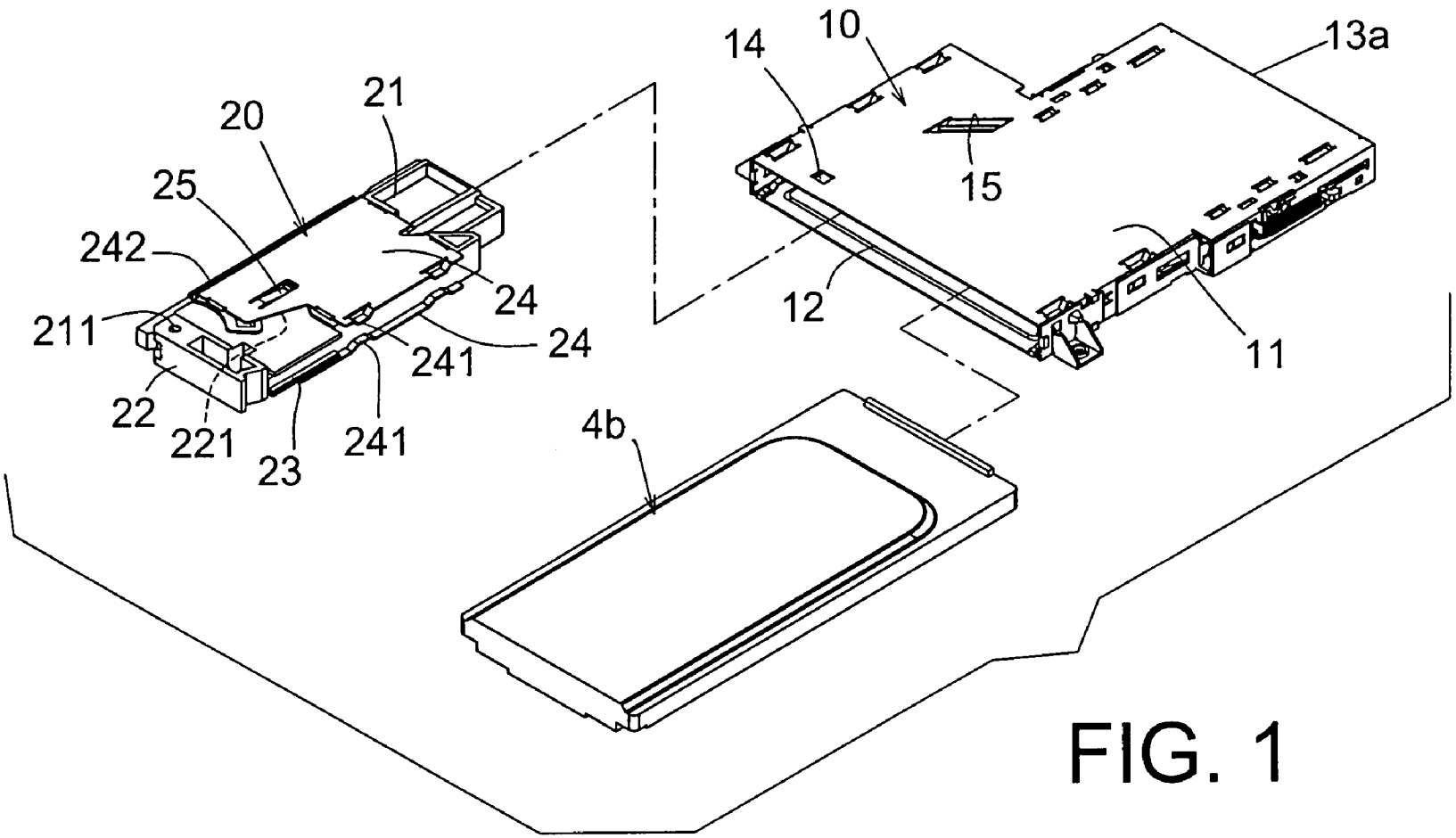
FIG. 1 is a perspective exploded view of the electronic card connector and the fake card of the present invention.
Figure 7:
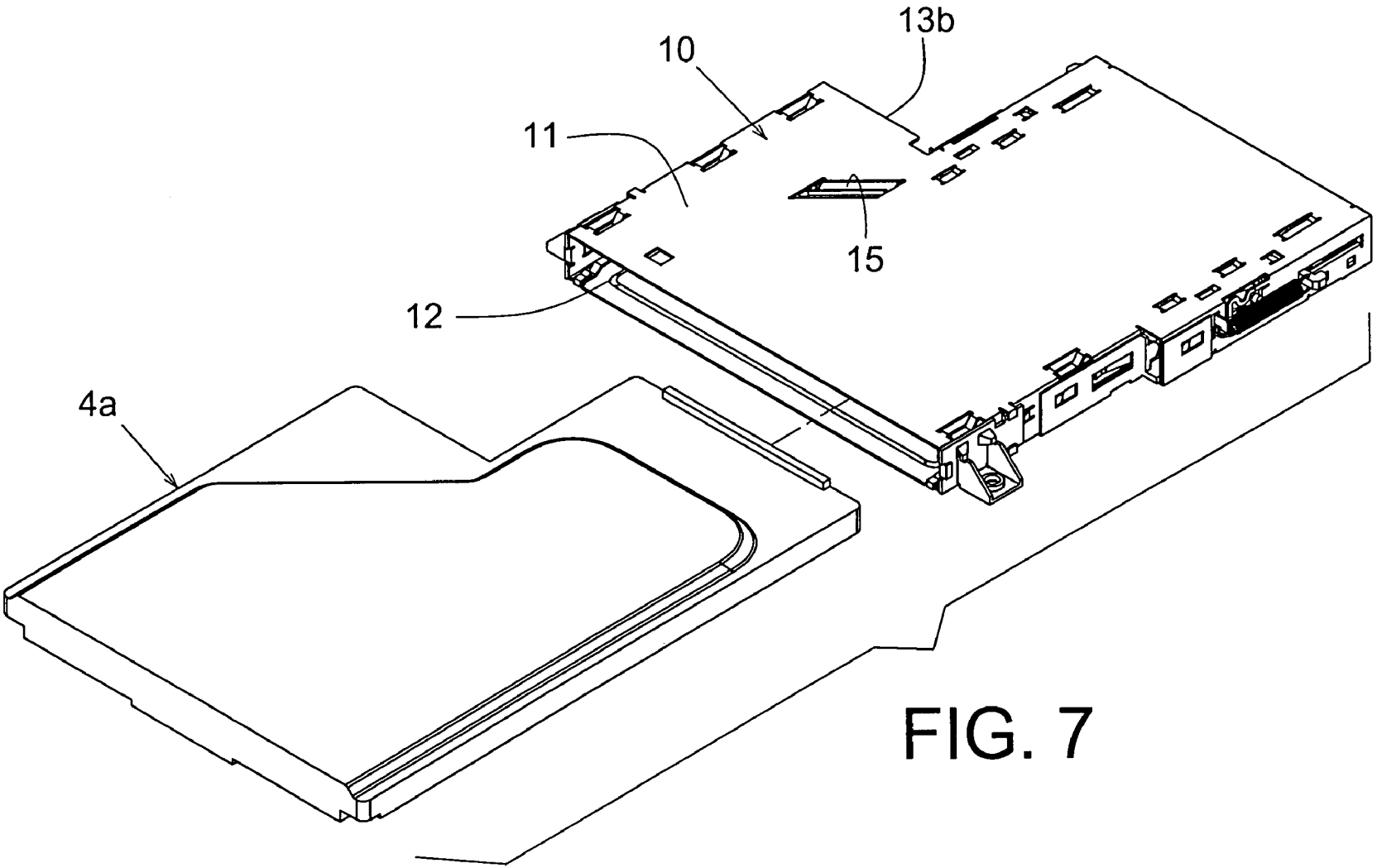
FIG. 7 is a perspective view showing that a first type of electronic card is inserted into the electronic card connector of the present invention.

The electronic card connector of the present invention is applicable to express card 4*b* as shown in FIG. 1 or the express card 4*a* as shown in FIG. 7. The type of the electronic card to which the present invention is applied is not limited.

Figure 3:
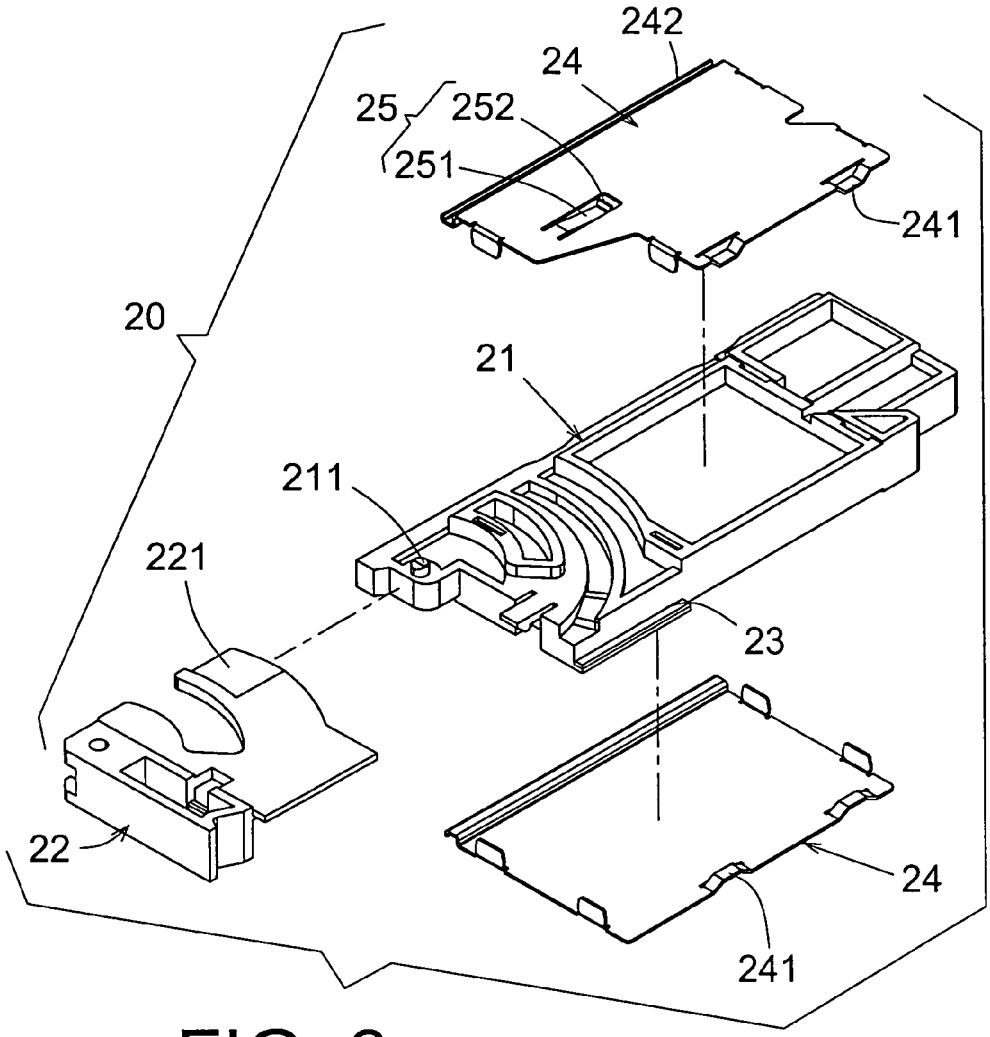
FIG. 3 is a perspective exploded view of the fake card of the present invention.
Figure 4:
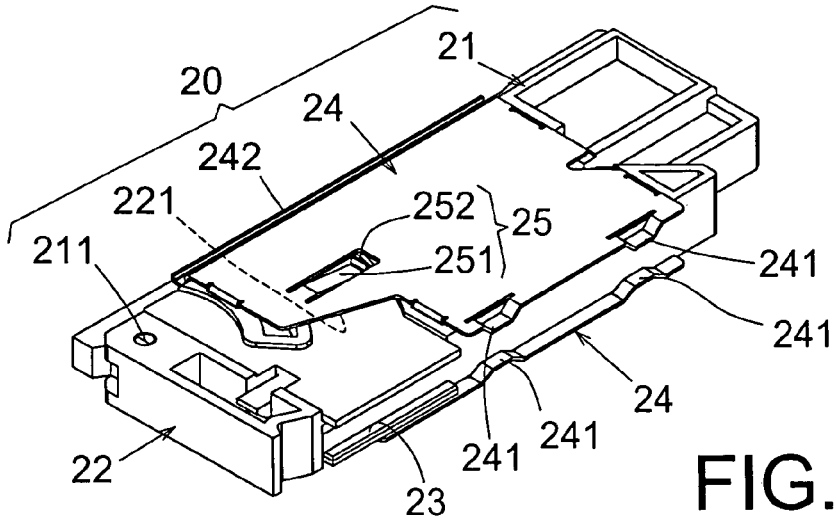
FIG. 4 is a perspective assembled view of the fake card of the present invention.

Referring to FIGS. 3 and 4, the fake card 20 of the present invention includes a card body 21. A first end of the card body 21 has a pivot section 211. One end of a pull section 22 is pivotally connected with the pivot section 211 of the card body 21. After outward turned, a user can pull the pull section 22 to draw out the card body 21.

A sidewall of the fake card 20 is formed with a guide rail section 23 adapted to the profile of a sidewall 41 of the inserted electronic card 4*b*. After the fake card 20 is inserted into the electronic card socket 12, the fake card 20 and the socket 12 define a space with a cross-section adapted to that of the inserted electronic card 4*b*. Accordingly, the electronic card 4*b* can be smoothly slid along the guide rail section 23 of the fake card 20 into the electronic card socket 12 of the electronic card connector 10.

The fake card 20 further includes a grounding plate 24 firmly latched on the card body 21 of the fake card 20. A first contact section 241 is formed on one side of the grounding plate 24 and protrudes from one side of the main body 11. A second contact section 242 is formed on the other side of the grounding plate 24. After the fake card 20 is inserted into the electronic card socket 12, the second contact section 242 contacts with a grounding circuit of the electronic card connector 10. When an electronic card 4*b* is inserted into the electronic card socket 12, the first contact section 241 contacts with outer wall of the electronic card 4*b* to complete a grounding circuit. Alternatively, two grounding plates 24 are respectively latched on opposite upper and lower sides of the card body 21. When an electronic card 4*b* is inserted into the electronic card socket 12, the first contact sections 241 of the grounding plates 24 oppositely clamp the opposite upper and lower sides of the electronic card.

Figure 2:
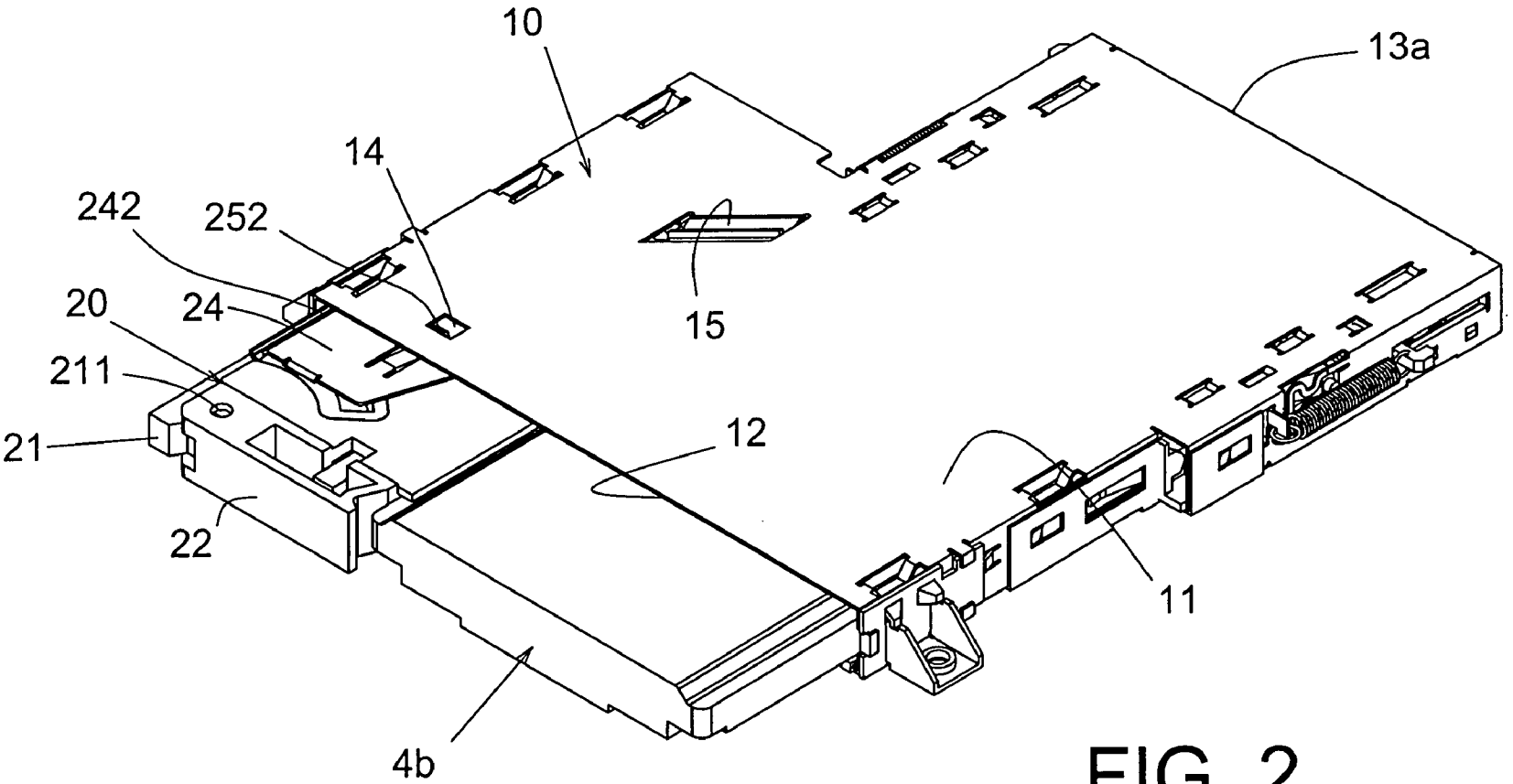
FIG. 2 is a perspective view showing that an electronic card and the fake card are both inserted in the electronic card socket of the electronic card connector of the present invention.

Referring to FIGS. 2 and 4, the fake card 20 further has at least one resilient latch member 25. When the fake card 20 is inserted into the electronic card socket 12, the resilient latch member 25 is resiliently latched in a corresponding latch hole 14 of the electronic card connector 10 so as to prevent the fake card 20 from being retreated and extracted out of the electronic card socket 12.

Figure 6:
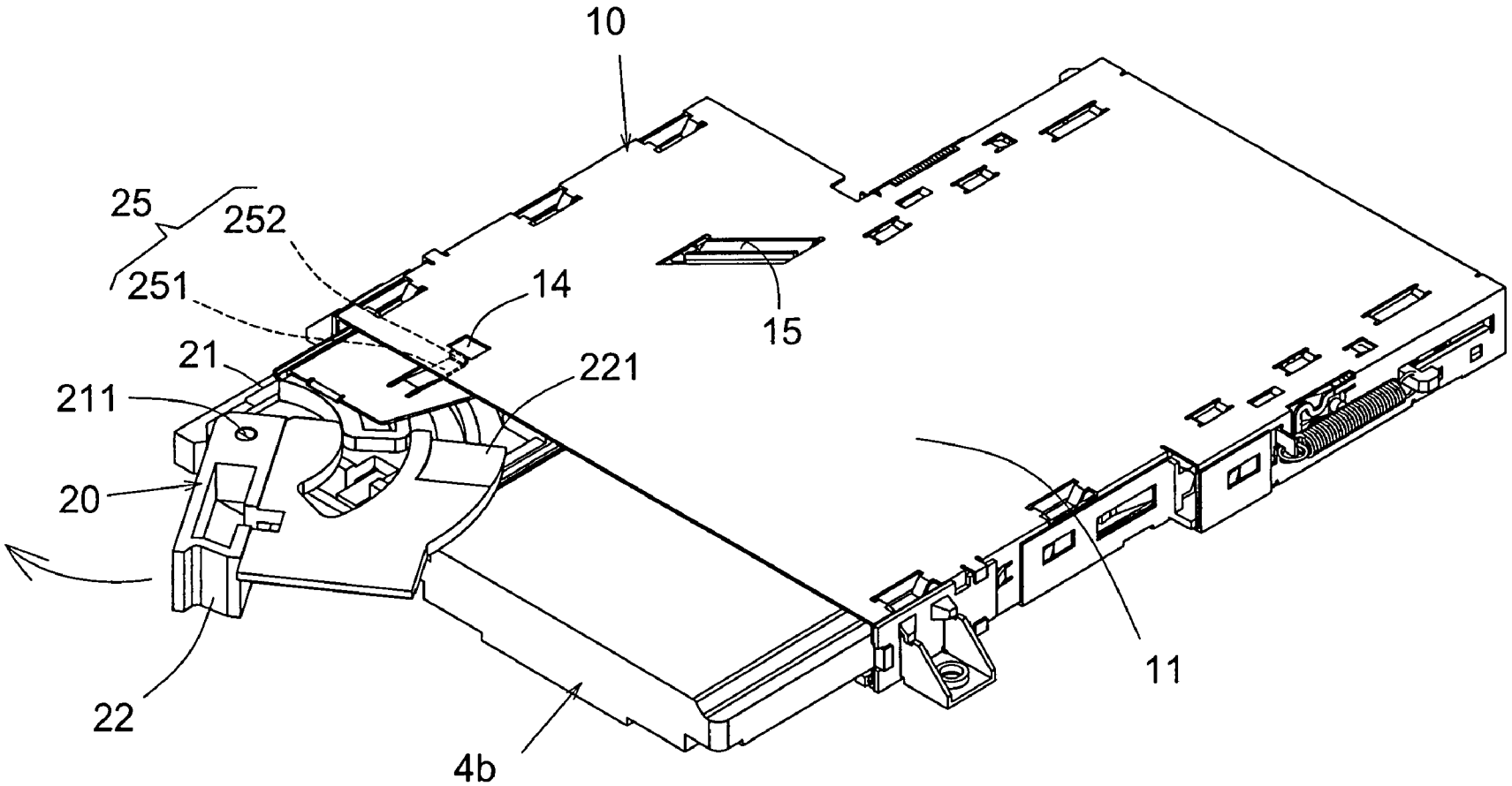
FIG. 6 is a perspective view showing that the fake card is drawn out of the electronic card connector of the present invention.

Referring to FIGS. 2, 3 and 4, the pull section 22 of the fake card 20 has a projecting lifting board 221. When the pull section 22 is contracted toward the card body 21 of the fake card 20, the lifting board 221 lifts the resilient arm 251 of the resilient latch member 25 from lower side thereof. Under such circumstance, a latch hook section 252 at free end of the resilient arm 251 is lifted to latch in the latch hole 14 of the electronic card connector 10. Therefore, the fake card 20 can be firmly latched in the electronic card socket 12. When a user desires to take out the fake card 20, as shown in FIG. 6, the user only needs to outward shift the pull section 22 and move the lifting board 221 away from the position under the resilient arm 251 of the resilient latch member 25. At this time, the resilient arm 251 can automatically resiliently restore. The latch hook section 252 of the free end of the resilient arm 251 is moved downward toward the card body 21 and unlatched from the latch hole 14 of the electronic card connector 10. Accordingly, via the pull section 22, the user can entirely draw the fake card 20 out of the electronic card socket 12 of the electronic card connector 10.

The resilient latch member 25 of the fake card 20 can be integrally formed on the grounding plate 24. Alternatively, the resilient latch member 25 of the fake card 20 can be integrally formed on the card body 21. The location of the resilient latch member 25 is not limited.

Referring to FIG. 3, the fake card 20 can be formed of several components. Alternatively, the fake card can be formed of one single member. For example, the fake card can be made of plastic material by integral molding. This is not limited.

Referring to FIG. 7, a grounding resilient plate 15 is further disposed on the main body 11 of the electronic card connector 10. The grounding resilient plate 15 extends into the electronic card socket 12 for contacting with the inserted electronic card 4*a* to complete the grounding of the electronic card 4*a*. Accordingly, the signal of the electronic card can be more stably transmitted.

Figure 5:
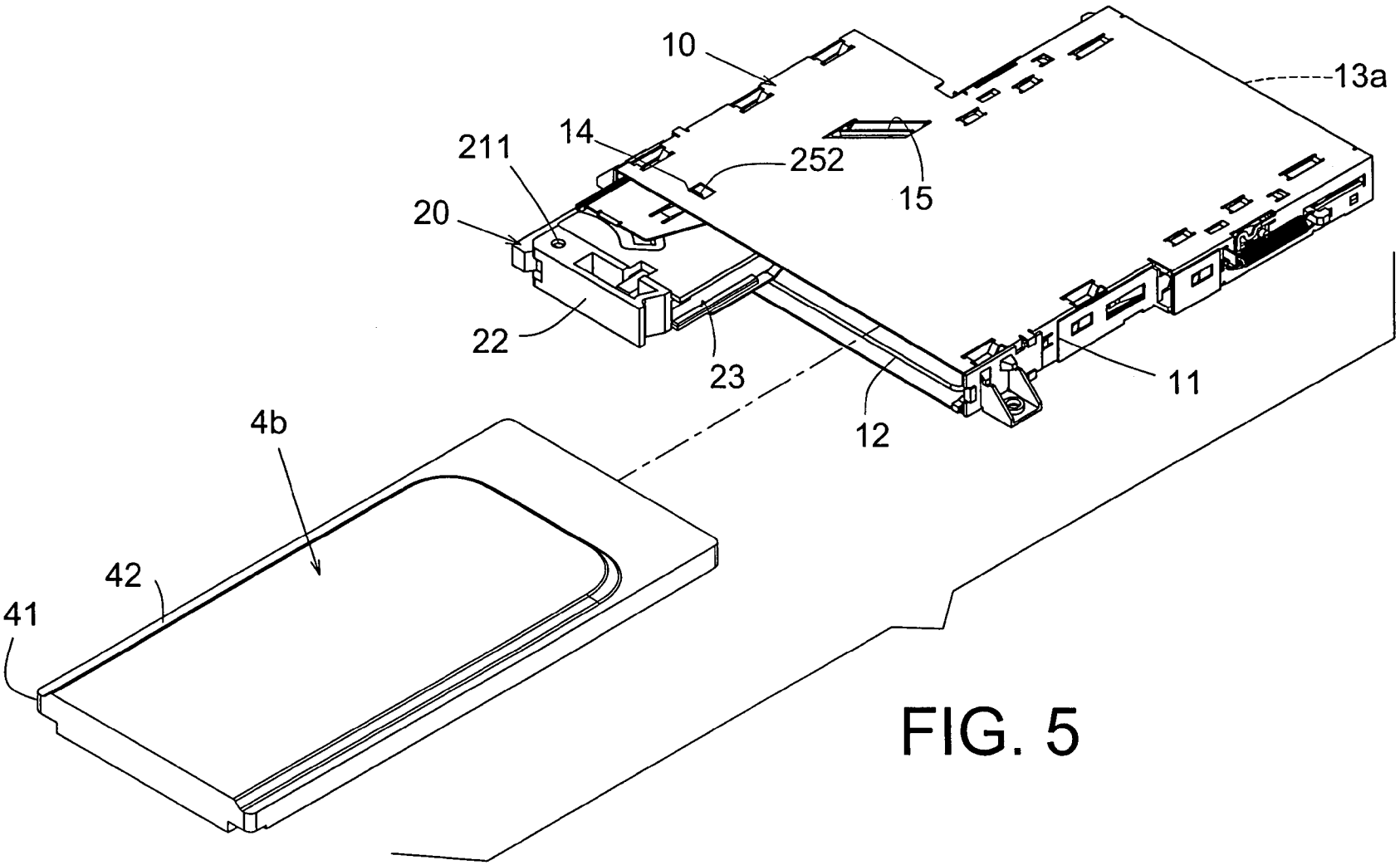
FIG. 5 is a perspective view showing that a second type of electronic card is inserted into the electronic card connector of the present invention.

In application, in the case that the electronic card 4*b* to be inserted into the electronic card socket 12 pertains to the second type of express cards with a width smaller than the width of the electronic card socket 12, a user can insert the fake card 20 into one side of the electronic card socket 12 as shown in FIG. 5. At this time, the fake card 20 and the electronic card socket 12 define therebetween a slide cavity adapted to the cross-section of the electronic card 4*b*. Accordingly, the electronic card 4*b* can be guided to smoothly slide into or retreat out of the electronic card socket 12. In the case that the electronic card 4*a* to be inserted into the electronic card socket 12 pertains to the first type of express cards with a width corresponding to the width of the electronic card socket 12, as shown in FIG. 7, two sides of the electronic card 4*a* can snugly attach to two sides of the electronic card socket 12. Therefore, the electronic card 4*a* can stably slide within the electronic card socket 12 without using the fake card 20. Under such circumstance, as shown in FIG. 6, the user can outward shift the pull section 22 of the fake card 20 to unlatch the fake card 20 from the electronic card connector 10. Then the fake card 20 can be drawn out of the electronic card socket 12. Then, as shown in FIG. 7, the electronic card 4*a* can be directly inserted into the electronic card socket 12 of the electronic card connector 10.

According to the above arrangement, the fake card 20 of the present invention can be inserted into the electronic card socket 12 of the electronic card connector, whereby the fake card 20 and the electronic card socket 12 define therebetween a space adapted to the electronic card 4*b*. When the electronic card 4*b* is inserted into the electronic card socket 12, the electronic card 4*b* is guided by the fake card 20 to truly slide into the electronic card socket 12 or retreat out of the electronic card socket 12. In addition, the inserted electronic card 4*b* is grounded via the grounding plate 24 of the fake card 20.

The above embodiments are only used to illustrate the present invention, not intended to limit the scope thereof. Many modifications of the above embodiments can be made without departing from the spirit of the present invention.

What is claimed is:

1. An electronic card connector with fake card, comprising:

a main body, a front end of the main body being inwardly recessed between opposing sides thereof to form an electronic card socket in which two different types of electronic cards are insertable to respectively correspondingly connect with terminals at a bottom end of the electronic card socket; and a fake card being insertable in the electronic card socket, the fake card having a pair of opposing sidewalls, a space being defined between one of the sidewalls of the fake card and a corresponding one of the sides of the electronic card socket in which only one type of electronic card is insertable, the one sidewall being formed with a guide rail section adapted to slidingly receive a sidewall portion of the inserted electronic card therein.

2. The electronic card connector with fake card as claimed in claim 1, wherein the fake card includes a card body, a pull section being pivotally connected with a first end of the card body.

3. The electronic card connector with fake card as claimed in claim 2, wherein at least one resilient latch member is integrally disposed on the card body of the fake card, whereby when the fake card is inserted into the electronic card socket, the resilient latch member is resiliently latched in a corresponding latch hole of the electronic card connector.

4. The electronic card connector with fake card as claimed in claim 2, wherein the pull section of the fake card has a projecting lifting board that is angularly displaced out of the card body responsive to pivotal displacement of the pull section, responsive to the pull section being displaced toward the card body of the fake card, the lifting board lifts a resilient arm of a resilient latch member of the fake card, whereby a latch hook section at a free end of the resilient arm is lifted to latch into a latch hole of the main body to prevent withdrawal of the fake card therefrom.

5. The electronic card connector with fake card as claimed in claim 1, wherein a grounding resilient plate is further disposed on the main body of the electronic card connector, the grounding resilient plate extending into the electronic card socket for contacting with the inserted electronic card to complete the grounding of the electronic card.

6. An electronic card connector with fake card, comprising:

a main body a front end of the main body being inwardly recessed to form an electronic card socket in which two different types of electronic cards are insertable to respectively correspondingly connect with terminals at a bottom end of the electronic card socket; and a fake card having a card body and being insertable into the electronic card socket, the fake card and the electronic card socket having a space defined therebetween in which only one type of electronic card is insertable the fake card further including a grounding plate firmly latched on the card body of the fake card, a first contact section being formed on one side of the grounding plate, a second contact section being formed on the other side of the grounding plate, whereby after the fake card is inserted into the electronic card socket, the second contact section contacts with a grounding circuit of the electronic card connector and when an electronic card is inserted into the electronic card socket, the first contact section contacts with the electronic card.

7. The electronic card connector with fake card as claimed in claim 6, wherein at least one resilient latch member is integrally disposed on the grounding plate, whereby when the fake card is inserted into the electronic card socket, the resilient latch member is resiliently latched in a corresponding latch hole of the electronic card connector.

* * * * *